US007361045B1

(12) United States Patent
Vinciguerra et al.

(10) Patent No.: US 7,361,045 B1
(45) Date of Patent: Apr. 22, 2008

(54) LOCKING DEVICE FOR AN ELECTRICAL RECEPTACLE

(76) Inventors: Mark T. Vinciguerra, 8917 SE. Sandy La., Hobe Sound, FL (US) 33455; Gregory J. Gore, P.O. Box 191, Doylestown, PA (US) 18901

( * ) Notice: Subject to any disclaimer, the term of this patent is extended or adjusted under 35 U.S.C. 154(b) by 0 days.

(21) Appl. No.: 11/669,563

(22) Filed: Jan. 31, 2007

(51) Int. Cl.
*H01R 13/625* (2006.01)

(52) U.S. Cl. ..... 439/346

(58) Field of Classification Search ..... 439/346, 439/296, 38, 347, 39
See application file for complete search history.

(56) References Cited

U.S. PATENT DOCUMENTS 2,732,531 A * 1/1956 Janowiec ..... 439/346
4,061,409 A * 12/1977 Bealmear ..... 439/346
4,085,991 A * 4/1978 Marshall et al. ..... 439/346
4,136,919 A * 1/1979 Howard et al. ..... 439/346
5,129,836 A * 7/1992 Ursich ..... 439/346
5,352,132 A * 10/1994 O'Keefe et al. ..... 439/346
5,427,543 A * 6/1995 Dynia ..... 439/346
5,791,931 A * 8/1998 Burkhart, Sr. ..... 439/346
6,193,539 B1 * 2/2001 Chang ..... 439/346
6,234,824 B1 * 5/2001 Chang ..... 439/346
7,083,458 B1 * 8/2006 Chang ..... 439/346

* cited by examiner

*Primary Examiner*—Michael C. Zarroli
*Assistant Examiner*—Phuongchi Nguyen

(57) ABSTRACT

A locking device for an electrical receptacle to prevent the withdrawal of an inserted male plug includes a magnet in slidable engagement with the receptacle body. An actuator arm moves the magnet between retracted and extended positions. Locking means in the receptacle body for engaging a hole in the blade of the plug is moved by the position of the magnet. When the actuator arm is in the extended position the magnet is positioned proximate the hole of the blade whereby the locking means is engaged with the blade by the force of attraction of the magnet. In one embodiment the actuator arm includes two magnets of opposite polarity and the locking means includes a third magnet. When the actuator arm is moved between extended and retracted positions, the magnets align to either retract or repel the locking means.

16 Claims, 4 Drawing Sheets

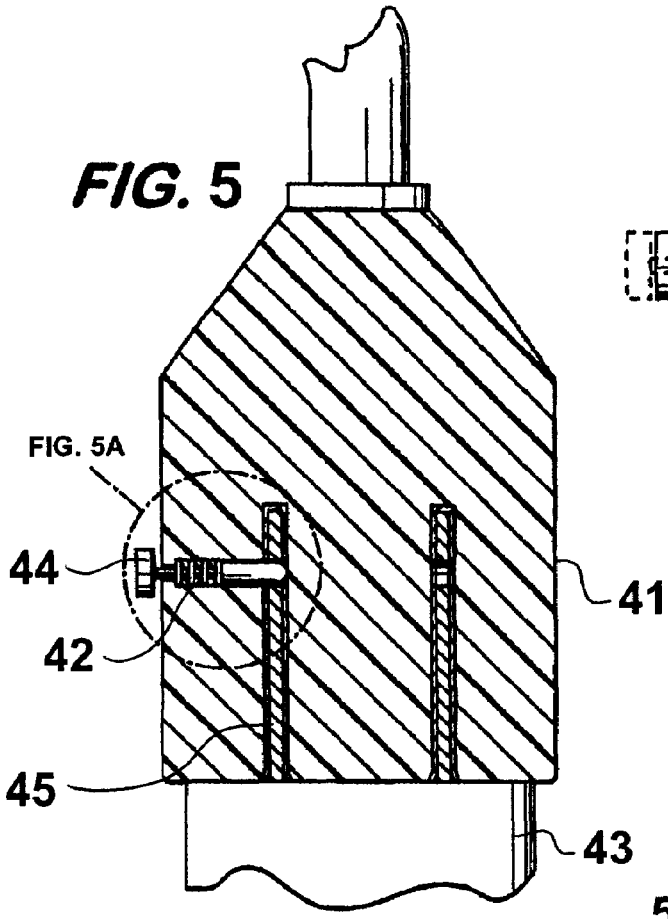
FIG. 5
FIG. 5A
44
42
45
41
43
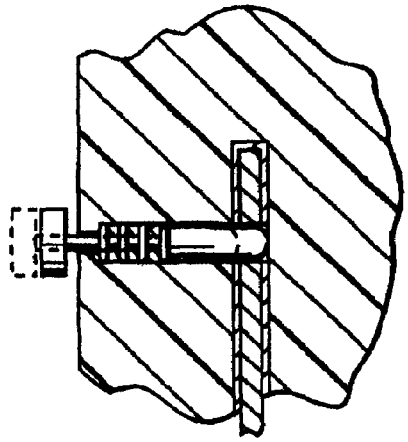
FIG. 5A
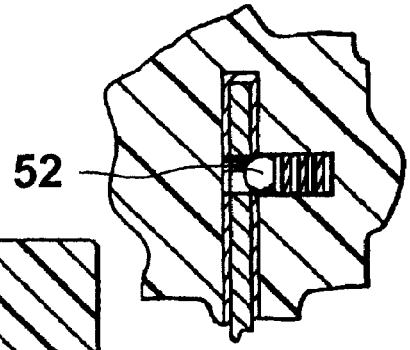
52
FIG. 6A
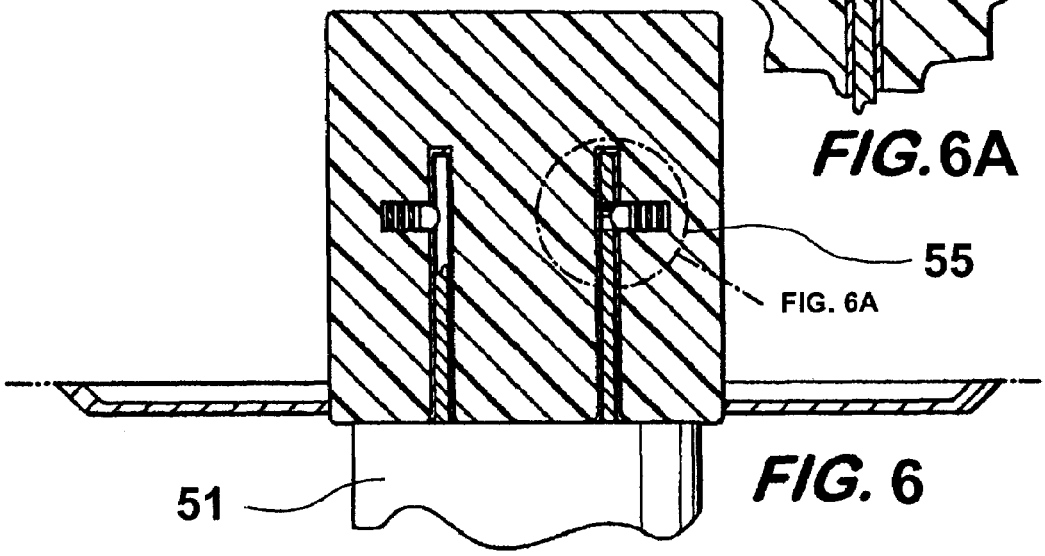
55
FIG. 6A
51
FIG. 6

FIG. 7
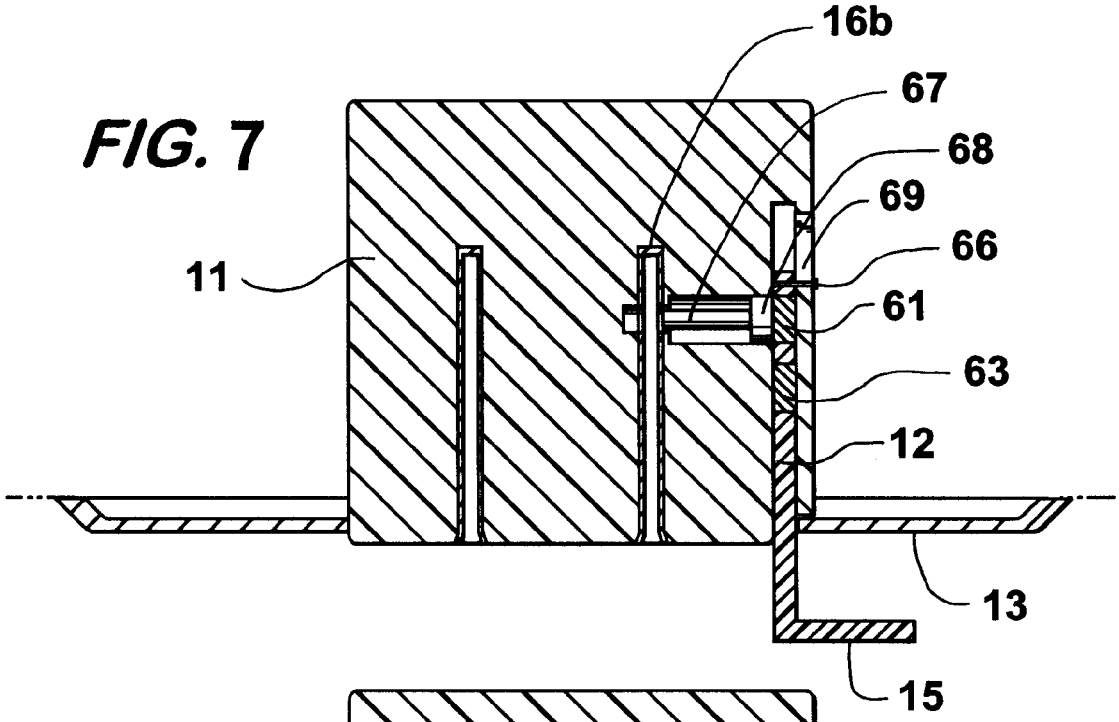
FIG. 8
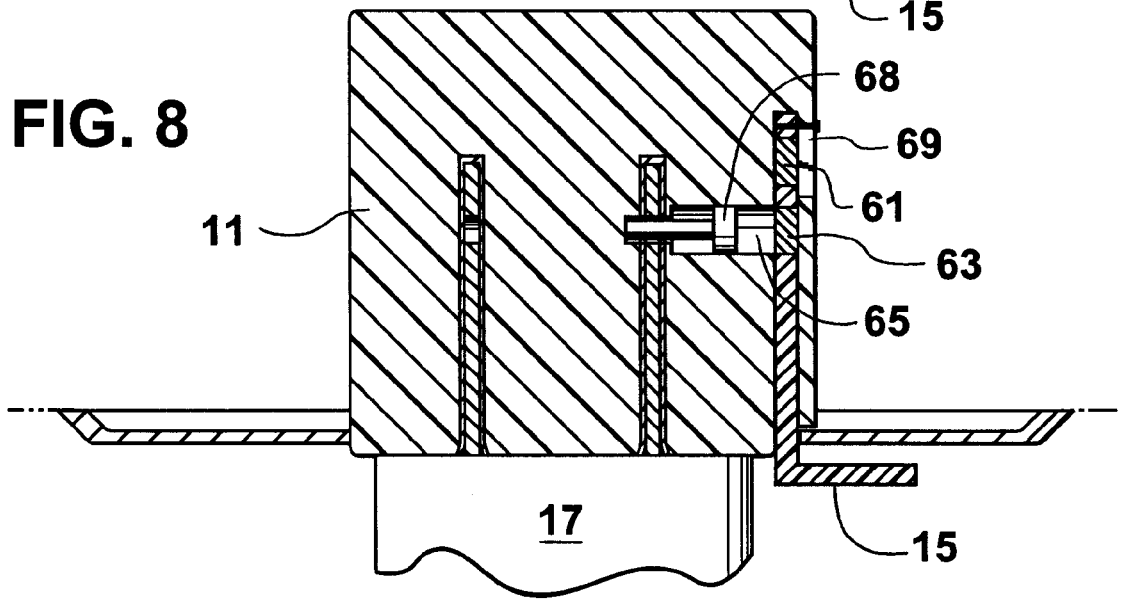
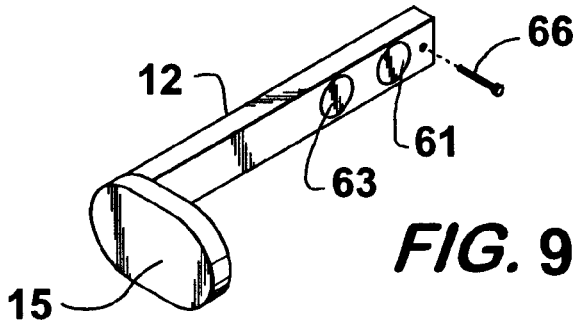
FIG. 9

LOCKING DEVICE FOR AN ELECTRICAL RECEPTACLE

FIELD OF THE INVENTION

The present invention relates to maintaining the male/female connection formed when using electrical appliance power cords. More specifically, the invention relates to a magnetically actuated locking mechanism suitable for use with household wall-mounted electrical outlets.

BACKGROUND OF THE INVENTION AND DESCRIPTION OF THE PRIOR ART

Appliance electrical cords are ubiquitous in society and are used throughout every home and on most all electrical appliances. Plug-in type electrical power cords are convenient for their ease of use but pose two problems. First, the power may be interrupted when the male end of the appliance cord is inadvertently pulled from its socket. Secondly, after the plug has been inadvertently removed, possibly by a child playing with the cord, the exposed socket may pose a safety hazard for children. The present invention has been devised to overcome these problems, providing continuous, uninterrupted power to appliances while preserving a safe environment for children.

It is known to use locking mechanisms to secure the blades of a plug in a receptacle as for example disclosed in U.S. Pat. No. 5,893,772 issued to Carmo et al. entitled "Locking Mechanism for an Electrical Connector." The device disclosed in this patent, like others of the prior art, requires forcible actuation and a complex mechanism for transferring the force from the actuator from the locking mechanism. A similar device is shown in U.S. Pat. No. 5,791,931 issued to Burkhart, Sr. entitled "Locking Electrical Outlet." Furthermore, it is known to use magnetism to lock joined electrical connectors such as disclosed in U.S. Pat. No. 2,735,990 issued to R. G. Gehlsen entitled "Magnet Controlled Connectors," however the type of connector disclosed in this patent requires the application of an external magnetic force of the outside to the connector in order to actuate the locking mechanism. Such a device would be impractical for everyday household use.

It is therefore the primary object of the invention to provide a locking mechanism for an electrical power cord which may be conveniently used by adults but which is difficult for a child to operate and therefore childproof. It is another object of the invention to provide a childproof locking mechanism which may be used with a wall outlet receptacle of the type commonly found in the home. It is another object of the invention to provide an electrical appliance plug locking device which is economical to manufacture and easy to use.

SUMMARY OF THE INVENTION

In order to meet the needs in the art described above, the present invention has been devised which in one embodiment utilizes magnetism as a force-transmitting element in the locking mechanism. This provides both the simplicity of design and also ease of use. While several embodiments of the invention are depicted below, all utilize the standard holes found in the blades of electrical plugs to secure the plug. In each case, either a locking pin or a detent mechanism engages the blade hole to hold the male plug in its fully inserted position.

More specifically, the applicant has invented a locking electrical receptacle to prevent the withdrawal of an inserted male plug comprising a receptacle body having electrical contact means for receiving the blades of an electrical plug that includes lateral holes. An actuator arm includes a magnet and is in slidable engagement with the receptacle body being movable between retracted and extended position. Locking means located on a first side of the blade is affixed to the receptacle body for engaging a hole in a blade of the plug when the plug is fully inserted. When the actuator arm is in the extended position, the magnet is positioned proximate the hole on a second side of the blade opposite the first side whereby the locking means is engaged with the blade by the force of attraction by the magnet. When the actuating arm is in the retracted position, the locking means is disengaged by spring means. The actuating arm includes a finger tab at a front end to assist manual movement of the actuator arm. A coverplate is affixed around a front surface of the receptacle body through which the actuator arm extends. Both the receptacle body and the coverplate may be affixed to a household wall. The locking means includes a ferro-magnetic plunger which is laterally slidable within the receptacle body and an elongate pin extends from the plunger that occupies the hole in the blade when the locking means is in the engaged position.

In a second embodiment, a locking electrical socket is designed to prevent the withdrawal of an inserted male plug such as an electrical joint of an extension cord with an appliance cord. Like the receptacle previously described, the socket body includes electrical contact means for receiving an electrical plug having a blade with a lateral hole. The locking means is slidably affixed to the socket body and includes a pin which is laterally movable into and out of engagement with the blade. The pin is spring-biased in the direction of engagement and extends through the blade hole. The pin further includes a head of enlarged diameter greater than the diameter of the pin for assisting in the manual movement of the pin between the engaged and disengaged positions. The head of the pin is manually accessible and extends beyond an outer side surface of the socket.

In another embodiment, the mechanism is not positively locking but increases the force required to withdraw an inserted male plug from an electrical receptacle. It is employed as above with a household electrical outlet having a receptacle body which has electrical contact means for receiving the blades of an electrical plug. At least one spring-biased detent mechanism has a ball which engages one of the holes in the blades of the plug when the plug is fully inserted into the receptacle body.

In another embodiment, the actuator arm includes first and second magnets, one magnet of opposite lateral polarity, the magnets being located on the arm and spaced longitudinally. Locking means are affixed to the body for engaging a hole in a blade of the plug when the plug is fully inserted into the receptacle body, the locking means including a third magnetic element. Went the actuator arm is in the extended position, the first magnet is positioned proximate the locking means whereby the third magnetic element is repelled by the first magnetic element whereby the locking means is moved to a position of engagement with the blade. When the actuator arm is in the retracted position, the second magnetic element is located adjacent the locking means whereby the third magnetic element is attracted to the second magnetic element thereby moving the locking means to a position of disengagement with the blade.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 5 is a top plan sectional view of an alternate embodiment of the invention applied to an extension cord electrical joint.

FIG. 5A is an enlarged view taken from FIG. 5 as shown in that figure with an alternate position of the locking mechanism shown in phantom.

FIG. 6 is a top plan sectional view of yet another embodiment of the invention in which a simple detent mechanism is employed.

FIG. 6A is an enlarged view taken from FIG. 6 as shown in that figure.

FIG. 7 is a top plan sectional view of an alternate embodiment of the invention in which three magnetic elements are utilized and the actuating arm is in the retracted position.

FIG. 8 is a top plan sectional view of the embodiment shown in FIG. 7 with the actuator arm in its extended position.

FIG. 9 is a top right isometric view of the actuator arm of the embodiment shown in FIGS. 7 and 8.

DESCRIPTION OF THE PREFERRED EMBODIMENT

Figure 1:
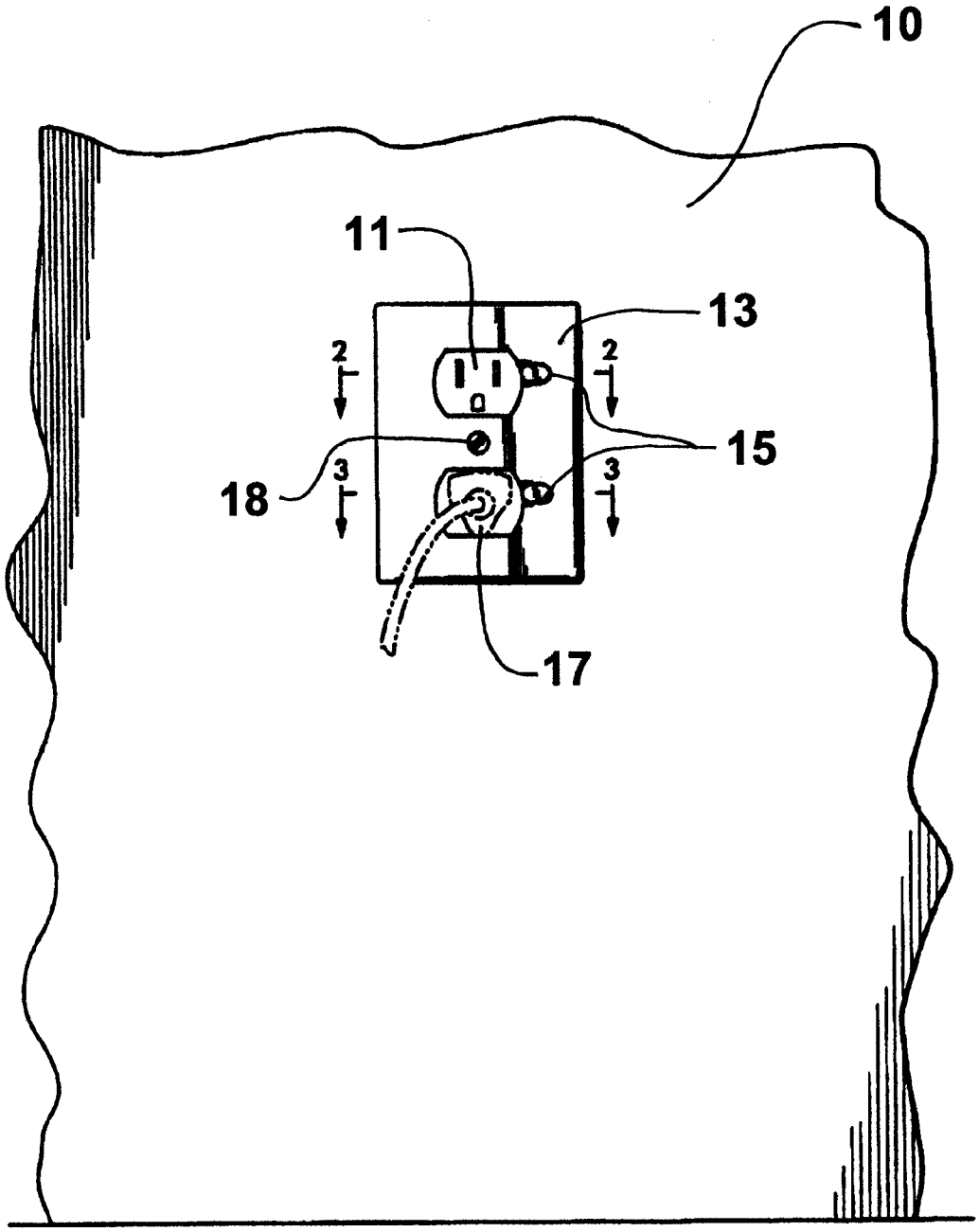
FIG. 1 is a front elevation view of the invention installed in a household wall electrical outlet.

Referring now to FIG. 1, the present invention is shown applied to a household wall electrical outlet. As shown in this figure, the outlet includes a pair of receptacles 11 as typically found in a household wall outlet which in this figure is mounted to wall 10. The receptacle pair is surrounded by a coverplate 13 affixed by screw 18. The outlets receive an electrical plug such as plug 17 found in this figure shown in phantom inserted into the lower receptacle. As will be more fully described in FIGS. 2, 3, and 4, the locking mechanism of the invention is actuated by push-pull finger tabs 15 which lie adjacent the coverplate 13. By extending (pushing) the tabs or retracting (pulling) them, the respective electrical plug can be selectively locked or released as desired.

Figure 2:
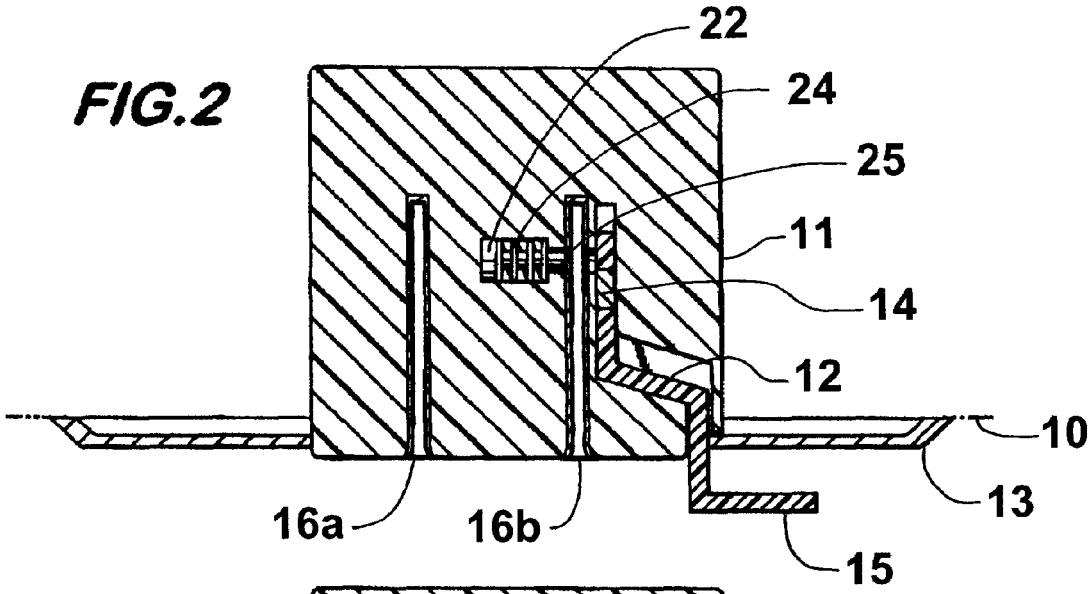
FIG. 2 is a top plan sectional view taken from FIG. 1 as shown in that figure.

Referring now to FIG. 2, the internal details of the invention depicted in FIG. 1 are shown. As mentioned above, the receptacle 11 is affixed to wall 10 and surrounded by coverplate 13. The receptacle includes slots 16*a* and 16*b* that receive the individual blades of the male electrical plug. The locking mechanism of the invention includes an actuator arm 12 which is manually moved by laterally projecting finger tab 15 at the front end of the arm. The rear portion of the actuator arm includes a magnet 14. The arm in this figure is shown in its retracted position and therefore the locking mechanism is disengaged. The locking mechanism in this embodiment is a pin and plunger assembly laterally movable within the body of the receptacle 11 that includes a ferromagnetic pin 25 which extends from a plunger that is biased away from the blade slot 16*b* by spring 24.

Figure 3:
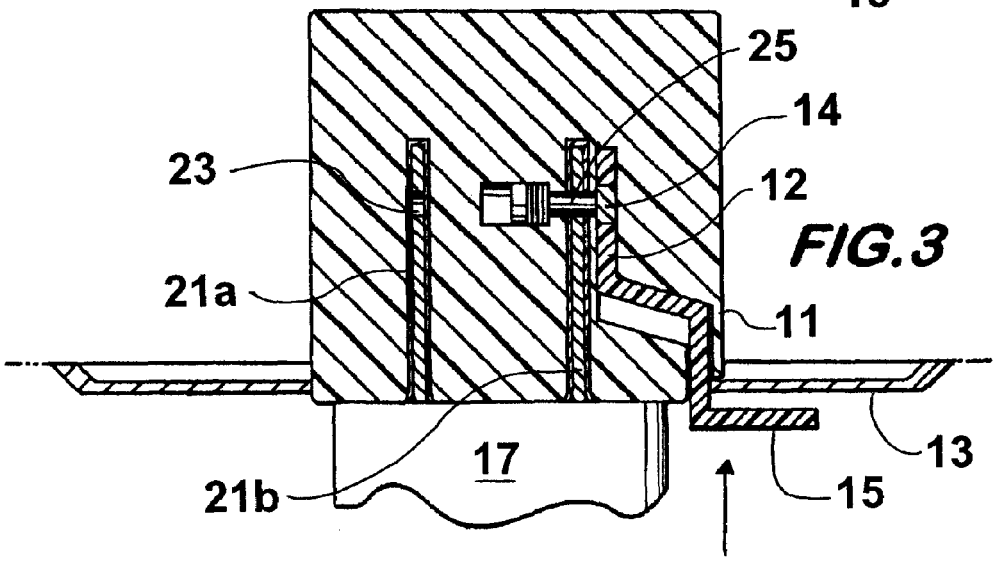
FIG. 3 is a top plan sectional view taken from FIG. 1 as shown in that figure.

Referring now to FIG. 3, plug 17 which includes blades 21*a* and 21*b* is fully inserted into receptacle 11 and the actuator arm has been pushed inward toward the coverplate 13. This places magnet 14 directly proximate the hole in blade 21*b* which is in alignment with the axis of locking pin 25. By the attraction of the magnetic force of magnet 14, the pin is moved laterally through the blade hole into the position shown in this figure. This provides a positive lock against the withdrawal of the plug 17 from the receptacle 11.

Figure 4:
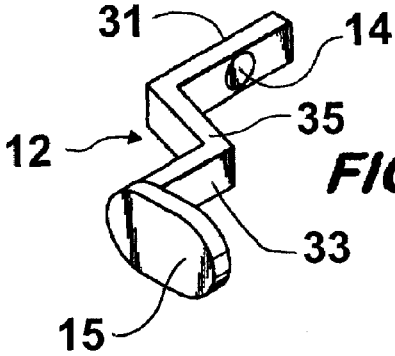
FIG. 4 is a top right front isometric view of the actuator arm.

Referring now to FIG. 4, greater detail of the actuator arm is shown. As described above, a rear portion of the arm 31 includes magnet 14. In order to achieve the placement of the magnet adjacent the blade slot and to provide clearance for the laterally extending tab 15, an intermediate cross member 35 of the arm 12 provides an offset between a front portion 33 which is substantially parallel to the rear portion 31. By these mechanical relations and in reference once again to FIGS. 2 and 3, it will be appreciated by those in the mechanical arts that the actuator arm is freely movable between two stable positions, one of extension and one of retraction, with only the force of contact sliding friction between the actuator arm and the receptacle body to overcome in moving the actuator arm. This permits the actuator arm tab 15 to be in near abutment with the coverplate and to have minimal clearance with the coverplate yet be manually operable by an adult. However, such a close clearance would prevent operation by the limited dexterity of a child, therefore making the present locking mechanism childproof.

Referring now to FIG. 5, an alternate embodiment of the invention is shown in this case applied to an extension cord electrical joint including a socket 41. In this embodiment, the locking mechanism is similar to that shown in FIGS. 1-3 except that the actuator pin is operated directly manually by pulling the head of the pin 44 to compress spring 42 and therefore move the mechanism between alternate positions as shown in FIG. 5A. The pin in this embodiment is spring-biased to the engaged position so that the pin must be pulled laterally outwardly before the plug blade 45 can be fully inserted. The pin is then released and the plug 43 locked in place.

Referring now to FIGS. 6 and 6A, another embodiment of the invention is shown which includes the use of a detent mechanism 55 as more specifically shown in FIG. 6A. In this embodiment the withdrawal force of the plug 51 from the receptacle body is increased by the detent mechanism but the plug is not positively locked. The detent mechanisms include a spring-biased ball 52 which moves partially into the plug blade holes when engaged, the ball being of substantially greater diameter than the blade hole.

Referring now to FIGS. 7, 8, and 9, yet another embodiment of the invention is shown which includes three magnetic elements. The arm 12 is in a simple L-shape and carries two magnets 61 and 63 which are oriented in reverse lateral polarity to the longitudinal direction of the arm. Also, locking pin 67 includes a plunger portion 68 which is either magnetized or composed of magnetic material. In this embodiment, the plunger slides freely within bore 65 of the receptacle 11 without a retraction spring although one may be added. No compression spring is required since movement of the pin is controlled only by the magnetic elements. As the arm 12 is moved by manually pushing or pulling on the tab 15, magnets 61 or 63 become selectively aligned with the locking pin bore. As shown in FIG. 7, the polarities of the magnetic elements are selected such that when the arm 12 is in a retracted position the magnetized plunger head 68 of pin 67 is attracted to magnet 61 and the pin is thus held in a retracted position being withdrawn from plug blade slot 16*b*. Arm 12 is retained within receptacle 11 from being completely withdrawn by a pin 66 which moves within a slot 69 inside of the receptacle. When the arm is pushed inward to its extended position as shown in FIG. 8, magnet 63 being of opposite lateral polarity to magnet 61 is now aligned with locking pin bore 65 such that the magnetic head 68 of the pin is repelled by magnet 63 and the pin is moved to a position of extension within the bore such that the end of the pin engages the plug blade hole to positively lock the plug 17 to the receptacle 11. Thus, moving the actuating arm between retracted and extended positions causes the pin 67 to retract and extend laterally to effect its locking engagement or disengagement with the plug blade aperture.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A locking electrical receptacle to prevent the withdrawal of an inserted male plug, comprising:

a receptacle body having electrical contact means for receiving the blades of an electrical plug, the blades including lateral holes therethrough;

an actuator arm is slidable engagement with said body movable between retracted and extended positions, said arm including a magnet;

locking means affixed to said body for engaging a hole in a blade of the plug when said plug is fully inserted into the receptacle body, said locking means located on a first side of the said blade; and when said actuator arm is in the extended positions, said magnet is positioned proximate said hole on a second side of said blade opposite said first side whereby said locking means is engaged with said blade only by the force of attraction by said magnet.

2. The locking electrical receptacle of claim 1 wherein said actuator arm is freely movable, being without mechanical connection to the blade locking elements of the locking means or any other mechanical elements of the receptacle.

3. The locking electrical receptacle of claim 1 wherein said actuator arm includes parallel front and rear positions joined by an interconnecting cross member.

4. The locking electrical receptacle of claim 1 wherein said locking means is spring-biased in the direction of disengagement.

5. The locking receptacle of claim 1 wherein said locking means is disengaged only by spring means when said actuating arm is in the retracted position.

6. The locking electrical receptacle of claim 5 wherein said actuating arm includes a finger tab at a front end thereof to assist movement of said actuator arm.

7. The locking electrical receptacle of claim 6 further including a coverplate affixed around a front surface of said receptacle body through which the actuator arm extends.

8. The locking electrical receptacle of claim 7 wherein said magnet is affixed to said front portion of said actuator arm and said front portion includes a laterally extending finger tab lying in near abutment with the coverplate when the arm is in the extended position.

9. The locking electrical receptacle of claim 7 wherein said locking means includes a ferro-magnetic plunger which is laterally slidable within said receptacle body.

10. The locking electrical receptacle of claim 9 wherein said receptacle body and said coverplate are affixed to a wall.

11. The locking electrical receptacle of claim 10 wherein said locking means includes an elongate pin extending from said plunger, said pin occupying said hole in said blade when said locking means is in the engaged position.

12. A locking electrical receptacle to prevent the withdrawal of an inserted male plug, comprising:

a receptacle body having electrical contact means for receiving the blades of an electrical plug, the blades including lateral holes therethrough;

an actuator arm in slidable engagement with said body movable between retracted and extended positions, said arm including first and second magnets, one magnet of opposite lateral polarity, said magnets located on said arm and spaced longitudinally;

locking means affixed to said body for engaging a hole in a blade of the plug when said plug is fully inserted into the receptacle body, said locking means including a third magnetic element; and when said actuator arm is in the extended position, said first magnet is positioned proximate said locking means whereby said third magnetic element is repelled by said first magnetic element whereby said locking means is moved to a position of engagement with said blade and when said actuator arm is in the retracted position, said second magnetic element is located adjacent said locking means whereby the third magnetic element is attracted to said second magnetic element thereby moving said locking means to a position of disengagement with said blade.

13. The locking electrical receptacle of claim 12 further including a coverplate affixed around a front surface of said receptacle body through which the actuator arm extends.

14. The locking electrical receptacle of claim 13 wherein said locking means includes a plunger which is laterally slidable within a bore of said receptacle body.

15. The locking electrical receptacle of claim 14 wherein said locking means includes an elongate pin extending from said plunger, said pin occupying said hole in said blade when said locking means is in an engaged position.

16. The locking electrical receptacle of claim 15 wherein said plunger comprises said third magnetic element.

* * * * *